US011607784B2

(12) United States Patent
Widner et al.

(10) Patent No.: US 11,607,784 B2
(45) Date of Patent: Mar. 21, 2023

(54) FAUCET CARTRIDGE REMOVAL TOOL

(71) Applicant: J & M Tool Design, LLC, Bradenton, FL (US)

(72) Inventors: Wayne Widner, Bradenton, FL (US); Randy Folk, Bradenton, FL (US)

(73) Assignee: J & M Tool Design, LLC, Bradenton, FL (US)

( * ) Notice: Subject to any disclaimer, the term of this patent is extended or adjusted under 35 U.S.C. 154(b) by 0 days.

(21) Appl. No.: 17/273,967

(22) PCT Filed: Sep. 10, 2019

(86) PCT No.: PCT/US2019/050275
§ 371 (c)(1),
(2) Date: Mar. 5, 2021

(87) PCT Pub. No.: WO2020/055774
PCT Pub. Date: Mar. 19, 2020

(65) Prior Publication Data

US 2021/0308848 A1 Oct. 7, 2021

Related U.S. Application Data

(60) Provisional application No. 62/728,993, filed on Sep. 10, 2018.

(51) Int. Cl.
*B25B 27/00* (2006.01)
*B25B 27/24* (2006.01)
*B25B 27/02* (2006.01)

(52) U.S. Cl.
CPC ..... *B25B 27/24* (2013.01); *B25B 27/023* (2013.01)

(58) Field of Classification Search
CPC ..... B25B 27/24; B25B 27/023; B25B 27/062
See application file for complete search history.

(56) References Cited

U.S. PATENT DOCUMENTS

| | | | | |
|---|---|---|---|---|
| 2,951,282 | A * | 9/1960 | Albright | B25B 27/023 29/259 |
| 4,079,494 | A | 3/1978 | Sutton et al. | |
| 5,054,179 | A | 10/1991 | Rini | |
| 5,119,556 | A | 6/1992 | Hseu | |
| 8,925,167 | B1 * | 1/2015 | Miller | B25B 27/023 29/256 |
| 2008/0235930 | A1 | 10/2008 | English | |
| 2014/0345100 | A1 | 11/2014 | Huang et al. | |
| 2018/0133876 | A1 | 5/2018 | Wilson | |

FOREIGN PATENT DOCUMENTS

| | | | |
|---|---|---|---|
| CN | 101628457 | B | 12/2012 |
| DE | 19803732 | A1 | 8/1999 |

OTHER PUBLICATIONS

International Search Report for PCT/US2019/050275 dated Nov. 12, 2019 (4 pages).
Written Opinion for PCT/US2019/050275 dated Nov. 12, 2019 (5 pages).
Supplementary European Search Report for EP 19861191.5 dated Jun. 15, 2022 (9 pages).

* cited by examiner

*Primary Examiner* — Lee D Wilson
(74) *Attorney, Agent, or Firm* — Shumaker, Loop & Kendrick, LLP

(57) ABSTRACT

A faucet cartridge removal tool that limits lateral movement of the tool and faucet cartridge during faucet cartridge removal.

13 Claims, 14 Drawing Sheets

FAUCET CARTRIDGE REMOVAL TOOL

TECHNICAL FIELD

The present invention relates generally to the field of faucet cartridge removal tools, and more particularly, to a faucet cartridge removal tool configured to linearly move, engage, and remove a faucet cartridge about a single axis with limited movement (e.g., lateral movement) of the tool and/or cartridge outside of the single axis, thus preventing and/or limiting accidental breakage of the faucet cartridge during removal from a faucet valve.

BACKGROUND

Faucet cartridges are included in faucets (e.g., sink and shower faucets) to regulate water flow and temperature. In essence, a faucet cartridge is the entire basis for the faucet's function—containing a rocker switch capable of blocking off or opening both hot and cold water lines entirely, as well as to varying degrees. For example, when the faucet lever (not shown) is raised to turn water on, the cartridge is pushed forward within faucet valve, causing both water lines to unblock. When the faucet lever is pushed down, both water lines are blocked entirely, turning off the water flow from the faucet. When centered, the faucet cartridge allows water from both lines (hot and cold water lines) to pass equally. When pressed to the left, the cartridge allows more water from the hot line pass than the cold line until the cold line is blocked entirely. Similarly, when pressed to the right, the cartridge allows more water from the cold line to pass than the hot line until the hot line is blocked entirely, thus allowing the faucet user to vary water temperature as desired.

In view of the above faucet and valve description, FIG. 1 specifically depicts a shower valve 300 having a faucet cartridge 200 (e.g., a MOEN® sink or shower faucet cartridge) inserted therein. The faucet cartridge 200 includes a main body 202 inserted within an opening of valve 300 at an intersection between the hot and cold water lines. As further shown in FIG. 1, faucet cartridge 200 further includes a stem 201 extending away from main body and positioned outside of valve 300 that is in operable connection with a faucet lever (not shown) when the faucet is fully assembled. As previously indicated above, cartridge 200 is positioned in valve 300 between the hot and cold water lines and functions to regulate water flow and temperature as described above. Due to normal use, faucet cartridges over time become worn and either completely lose operability or, alternatively, have less that optimal function, which undesirably results in loss of water flow and/or water temperature regulation. When this occurs, faucet cartridge(s) 200 must be removed from the valve 300 and subsequently replaced to restore proper faucet function (i.e., proper, desired water flow and temperature regulation from a faucet).

When replacing worn out faucet cartridges, specialized tools such as the conventional faucet cartridge removal tool 10 shown in FIG. 2 are used. Conventional faucet cartridge removal tool 10 includes main body 11 having a solid shaft 12 extending there through and handle 15 formed thereon. Solid shaft 12 includes threaded portion 14 positioned at one end and shaft head 13 positioned at the opposite end. Shaft 12 is configured to be advanced down (direction $D^1$) and up (direction $D^2$) about a single axis through main body 11. In view of FIGS. 1 and 2 and when replacing cartridge 200, shaft 12 may be advanced in direction $D^1$ such that threaded portion 14 enters into an inner diameter of stem 201 and threadedly engages stem 201 thereby securing tool 10 to cartridge 200. After threaded engagement between tool 10 and cartridge 200, which occurs thereby securing the tool to the cartridge, the tool user grips and pulls handle 15 in a direction ($D^2$) opposite of $D^1$ (i.e., the same axial direction used when engaging threaded portion 14 to stem 201) to forcibly remove cartridge 200 from valve 300.

Although conventional faucet cartridge removal tool(s) 10 are somewhat effective for removing faucet cartridge(s) 200 from valve 300, several problems frequently occur when using tool 10 to remove these cartridges 200. For example, when forcibly removing cartridge 200 with tool 10 from valve 300, tool 10 fails to limit lateral movement (or side to side motion) in direction $D^3$ relative to the tool's longitudinal axis. Because this lateral movement (or side to side motion) is not limited or completely eliminated by tool 10, the tool user frequently breaks stem 201, main body 202, and/or threaded portion 14 during cartridge removal, which in turn further complicates an already complicated cartridge removal process. Therefore, a need exists to provide a more effective cartridge tool that avoids the above mentioned problems frequently observed with conventional faucet cartridge removal tool(s).

SUMMARY

It is an object to provide a more effective faucet cartridge tool that avoids the problems frequently observed with conventional faucet cartridge removal tool(s). Thus, disclosed is a faucet cartridge removal tool that limits lateral movement of the tool and faucet cartridge during faucet cartridge removal. The tool includes (a) a hollow cylindrical main body configured to seat on a faucet valve or faucet cartridge lip to limit lateral movement of the tool while in use, the hollow cylindrical main body having one or more windows formed thereon for viewing engagement between the tool and faucet cartridge while in use; (b) a first movement member partially housed within the hollow cylindrical main body and configured to move about a single linear axis ($A^1$) above and below the hollow cylindrical main body relative to a longitudinal axis ($L^1$) of the tool while in use, the first movement member comprises (i) a rod partially housed within the main body and viewable through one or more windows of the hollow cylindrical main body, (ii) a handle positioned on one end of the rod that is configured to selectively move the solid rod within the main body in a first direction ($D^1$) about the single linear axis ($A^1$), and (iii) a faucet cartridge engagement member positioned on a second end of the rod that is configured to fixedly engage the faucet cartridge during faucet cartridge removal; and (c) a second movement member that is configured to move the rod in a second direction ($D^2$) about the single linear axis ($A^1$) that is opposite the first direction ($D^1$) to remove the faucet cartridge during faucet cartridge removal while concurrently maintaining engagement between the faucet cartridge engagement member and faucet cartridge and limiting lateral movement of the tool.

In certain aspects, the rod rotationally moves in a clockwise manner about the single linear axis in the first direction when advancing the rod through the main body.

In certain aspects, the engagement member includes a threaded portion configured for engagement within a threaded inner diameter of a stem of the faucet cartridge.

In certain aspects, engagement member extends below the solid rod of the first member and has a smaller outer diameter ($OD^2$) than the outer diameter (OD) of the rod (solid rod), the outer diameter ($OD^2$) of the engagement member is at least partially threaded along its length and configured for engagement within a threaded inner diameter of a stem of a faucet cartridge.

In certain aspects, the second movement member is positioned between the handle and hollow cylindrical main body.

In certain aspects, a portion of the rod of the first movement member is enclosed within the second movement and circumferentially engaged with the second movement member such that the rod may be moved in a second direction about the single linear axis that is opposite the first direction to remove the faucet cartridge during faucet cartridge removal while concurrently maintaining engagement between the faucet cartridge engagement member and cartridge and limiting lateral movement of the tool.

In certain aspects, the engagement member is attached to a bottom of the rod and extends below the rod of the first member in a direction away from the tool and has a smaller outer diameter ($OD^2$) than an outer diameter ($OD^1$) of the rod (solid rod), the outer diameter of the engagement member is completely threaded along its length and configured for engagement within a threaded inner diameter of a stem of a faucet cartridge such that the bottom of the rod is flush with and adjacent to an outermost surface of the faucet cartridge when the engagement member is completely engaged with the faucet cartridge.

In certain aspects, the handle is transverse relative to the longitudinal axis of the tool and extends beyond the outer most surfaces of the second movement member and hollow cylindrical main body to facilitate a user's ease of gripping and operating the tool.

In certain aspects, the handle is substantially "T" shaped.

In certain aspects, also disclosed is a kit comprising the faucet cartridge removal tool disclosed in any of the above aspects. For example, the faucet cartridge removal tool included within the kit includes (a) a hollow cylindrical main body configured to seat on a faucet valve or faucet cartridge lip to limit lateral movement of the tool while in use, the hollow cylindrical main body having one or more windows formed thereon for viewing engagement between the tool and faucet cartridge while in use; (b) a first movement member partially housed within the hollow cylindrical main body and configured to move about a single linear axis ($A^1$) above and below the hollow cylindrical main body relative to a longitudinal axis ($L^1$) of the tool while in use, the first movement member comprises (i) a rod partially housed within the main body and viewable through one or more windows of the hollow cylindrical main body, (ii) a handle positioned on one end of the rod that is configured to selectively move the solid rod within the main body in a first direction (D) about the single linear axis ($A^1$), and (iii) a faucet cartridge engagement member positioned on a second end of the rod that is configured to fixedly engage the faucet cartridge during faucet cartridge removal; and (c) a second movement member that is configured to move the rod in a second direction ($D^2$) about the single linear axis ($A^1$) that is opposite the first direction ($D^1$) to remove the faucet cartridge during faucet cartridge removal while concurrently maintaining engagement between the faucet cartridge engagement member and faucet cartridge and limiting lateral movement of the tool.

In certain aspects, also disclosed is a method of removing a faucet cartridge comprising: (a) providing the faucet cartridge removal tool disclosed herein; (b) placing or seating the hollow cylindrical main body of the faucet cartridge removal tool on a faucet valve or faucet cartridge lip having the faucet cartridge positioned therein such that lateral movement of the tool relative to the faucet cartridge, faucet valve, and/or faucet cartridge lip is reduced and/or eliminated while the tool is in use; (c) after step (b), while the hollow cylindrical main body remains placed or seated on the faucet valve or faucet cartridge lip, rotating the handle of the tool such that the rod and faucet cartridge engagement member of the first movement member concertedly move about a single axis in a first direction ($D^1$) towards the faucet cartridge until the faucet cartridge engagement member fixedly engages the cartridge member; (d) after step (c) and while the hollow cylindrical main body remains placed or seated on the faucet valve or faucet cartridge lip, rotating a second movement member of the tool that moves the rod in a second direction ($D^2$) about the single axis ($A^1$) that is opposite the first direction ($D^1$) away from the faucet valve to completely remove the faucet cartridge from the faucet valve while concurrently maintaining engagement between the faucet cartridge engagement member and faucet cartridge and limiting lateral movement of the tool. In certain aspects, the engagement member of the tool used in the method comprises a threaded portion configured for engagement within a threaded inner diameter of a stem of the faucet cartridge. In certain aspects, the engagement member extends below the rod of the first member and has a smaller outer diameter ($OD^2$) than an outer diameter ($OD^1$) of the rod (solid rod), the outer diameter of the engagement member is at least partially threaded along its length and configured for engagement within a threaded inner diameter of a stem of a faucet cartridge. In certain aspects, the second movement member of the tool used in the method is positioned between the handle and hollow cylindrical main body. In the method, each direction of movement ($D^1$) and ($D^2$) are preferably linear movements about the same axis in opposite directions.

Embodiments of the invention can include one or more or any combination of the above features and configurations.

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

Figure 1:
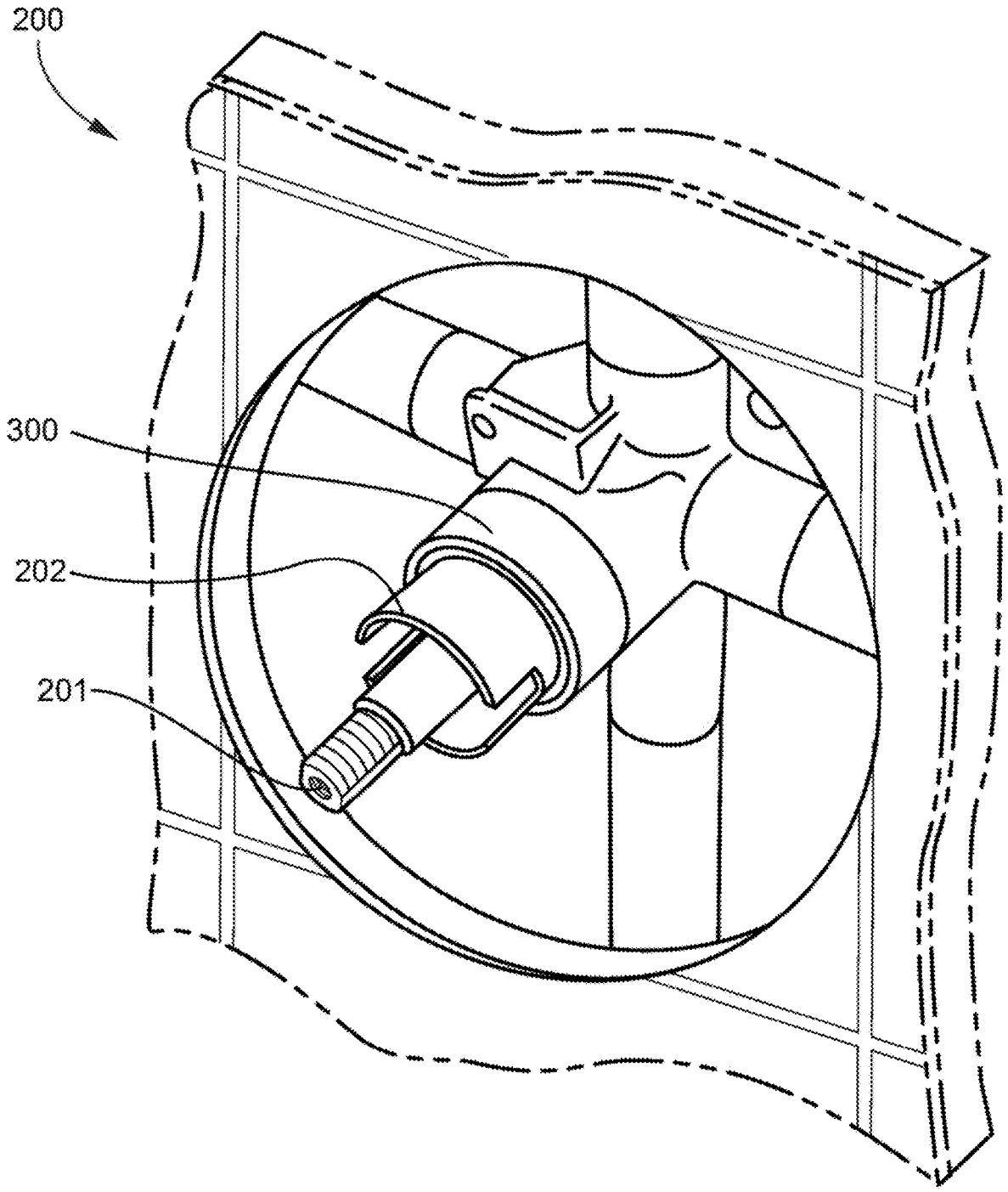
FIG. 1 shows a faucet cartridge inserted in a valve.
Figure 2:
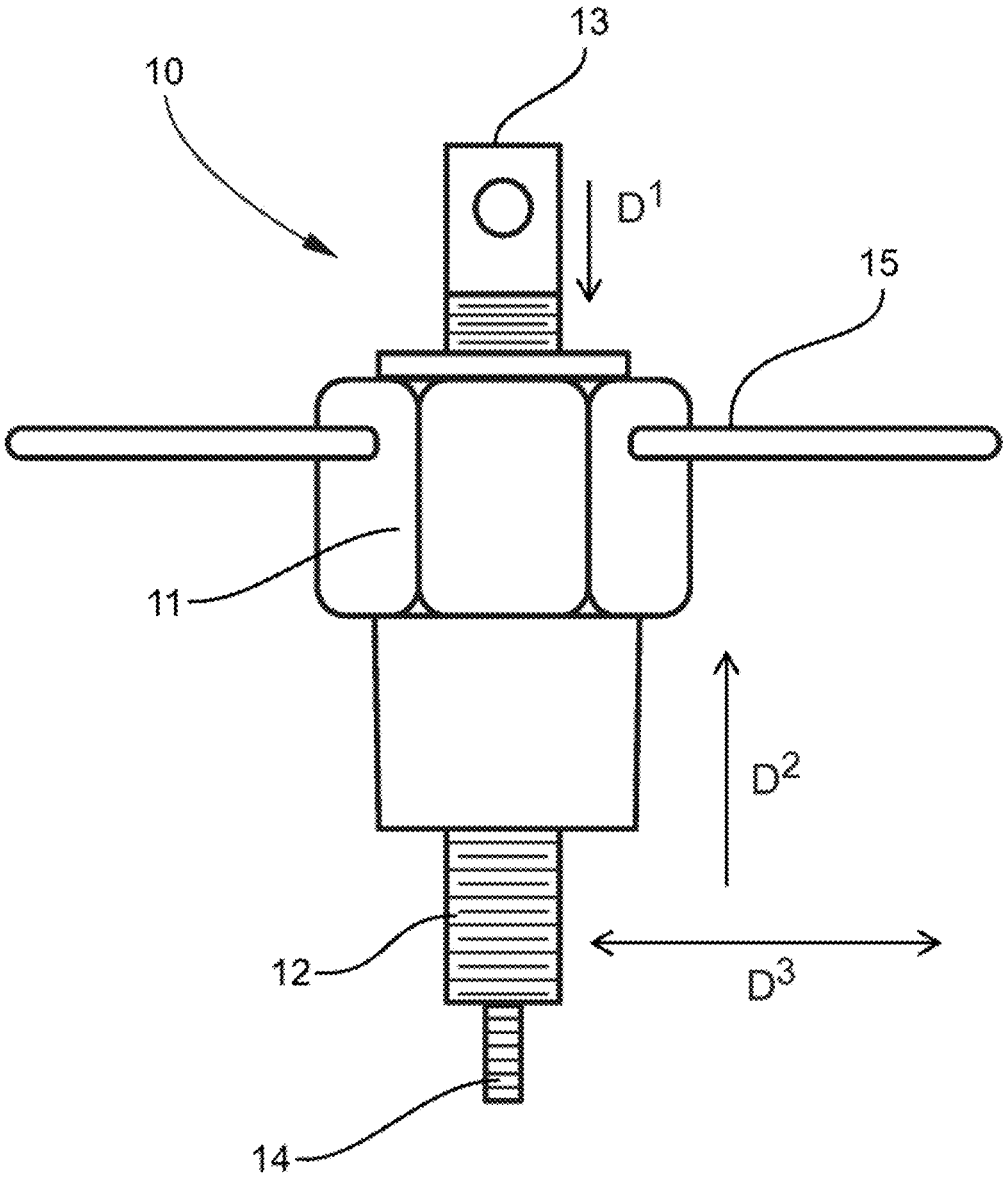
FIG. 2 (Prior Art)
FIG. 2 shows a conventional faucet cartridge removal tool.
Figure 3:
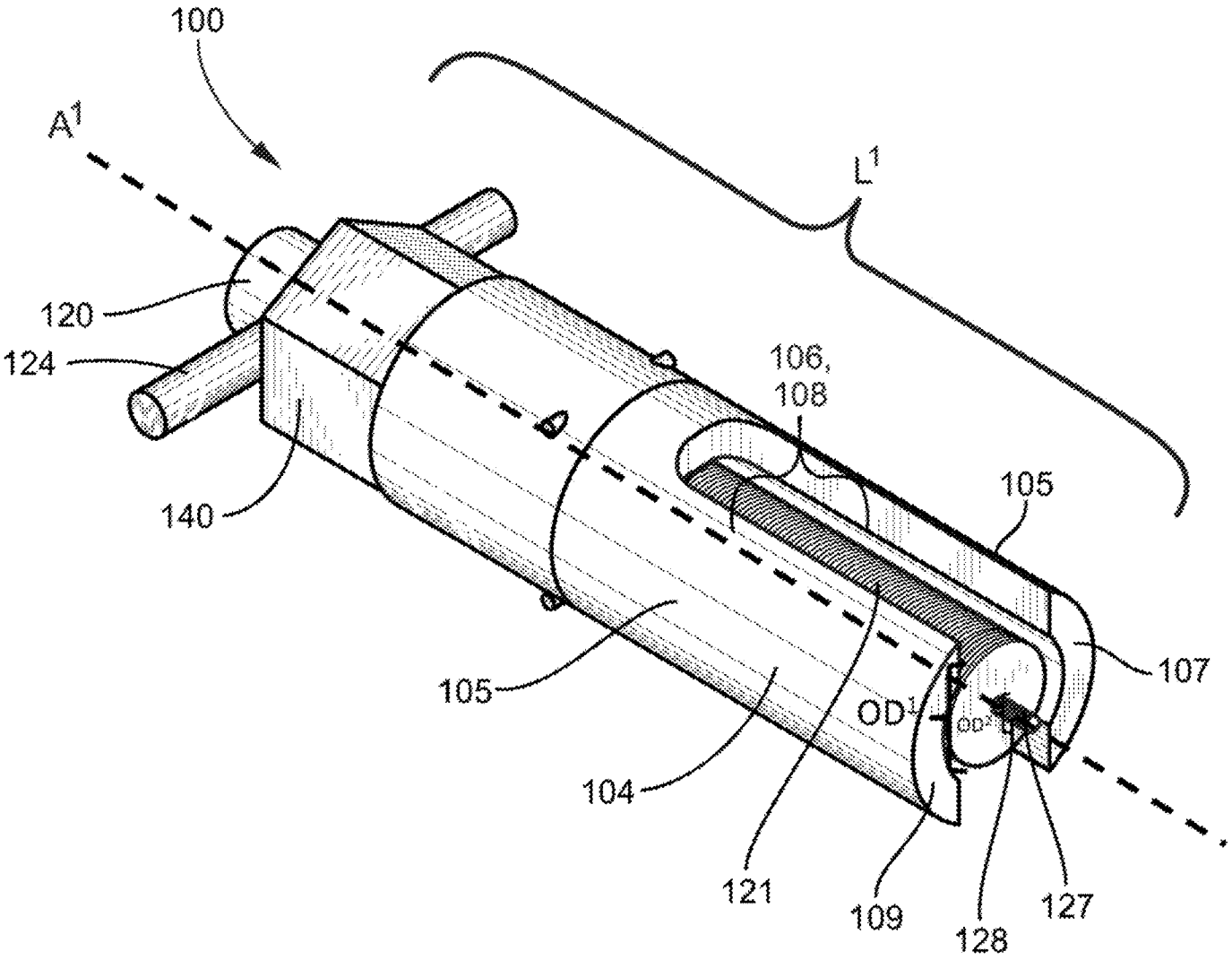
FIG. 3 depicts a perspective view of the faucet cartridge removal tool disclosed herein.
Figure 4:
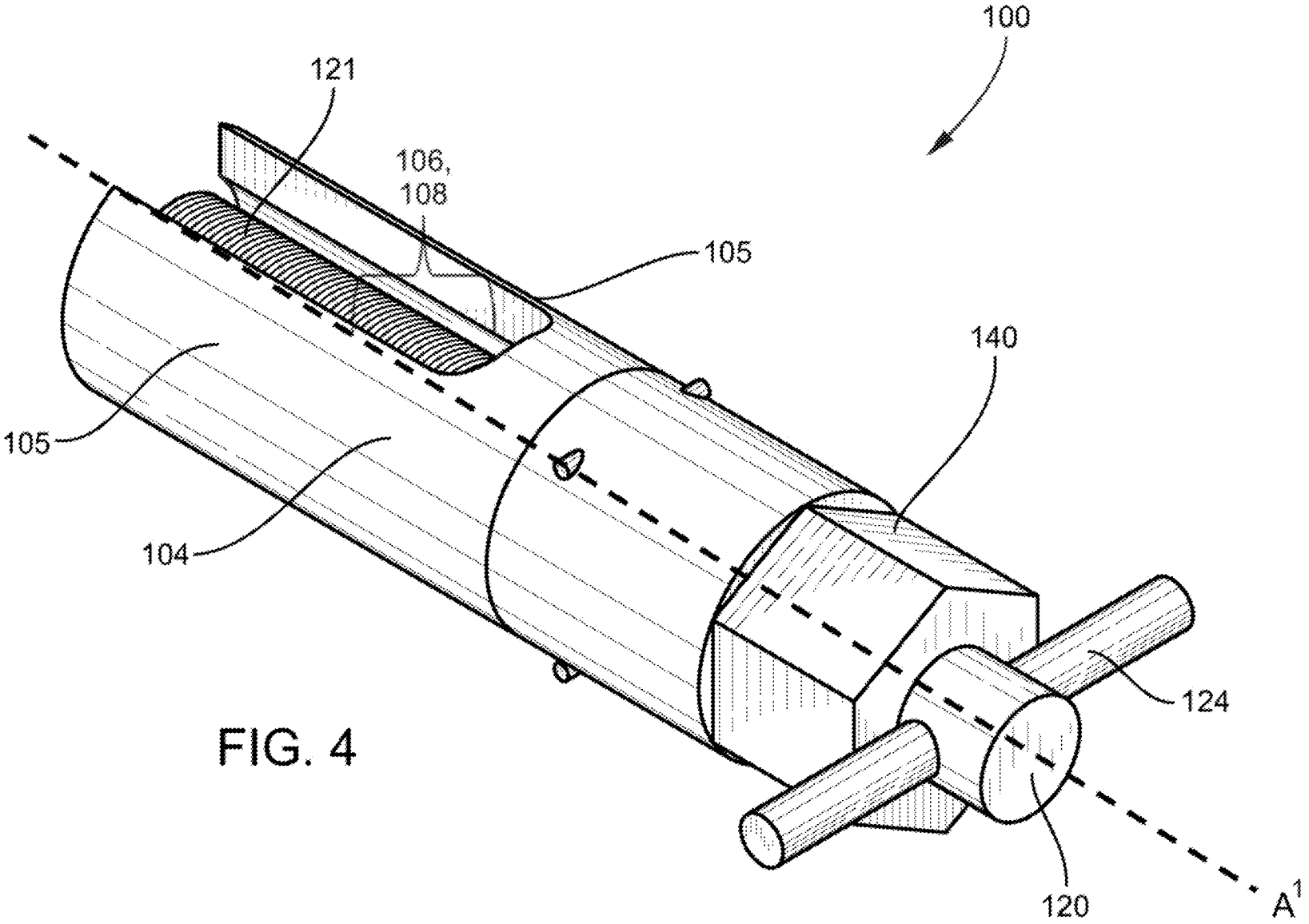
FIG. 4 depicts another perspective view of the faucet cartridge removal tool disclosed herein.
Figure 5A:
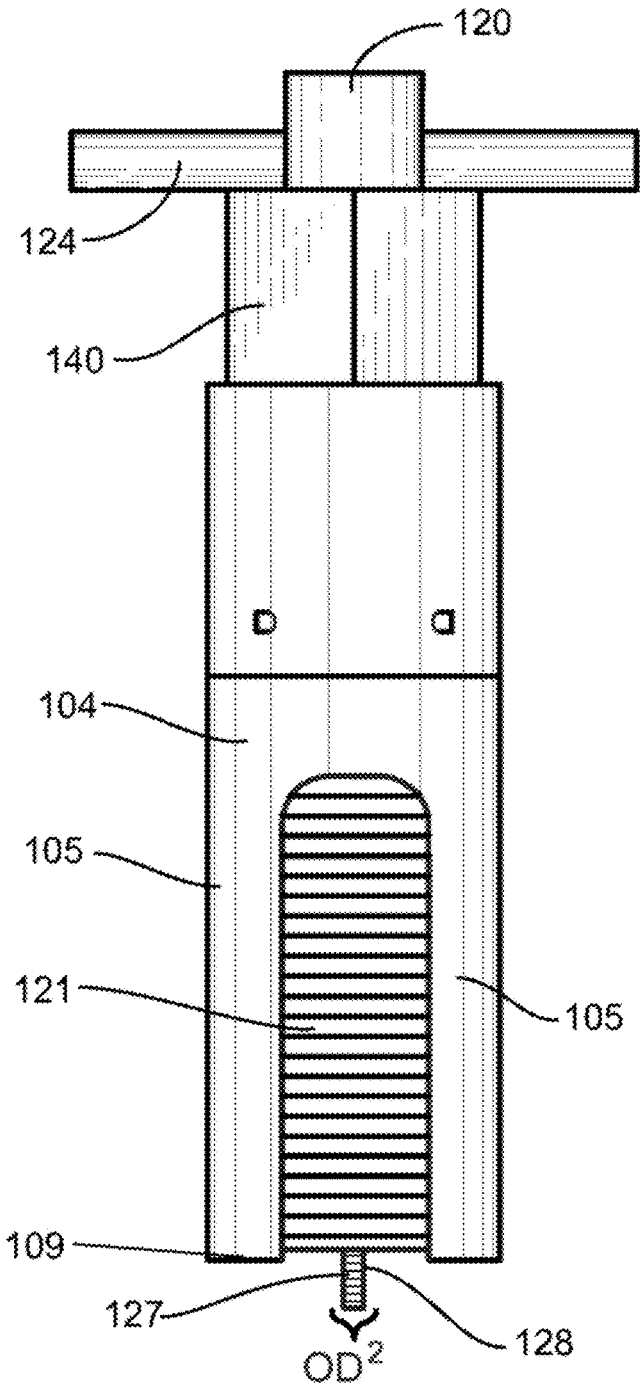
FIGS. 5A and 5B depict a first and second side view respectively of the faucet cartridge removal tool disclosed herein.
Figure 5B:
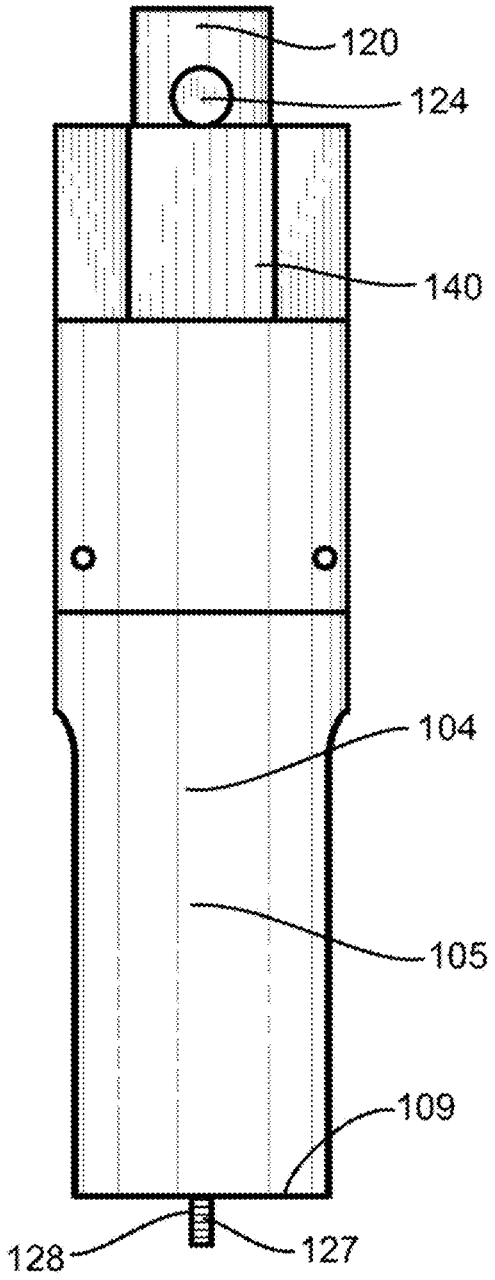
Figure 6:
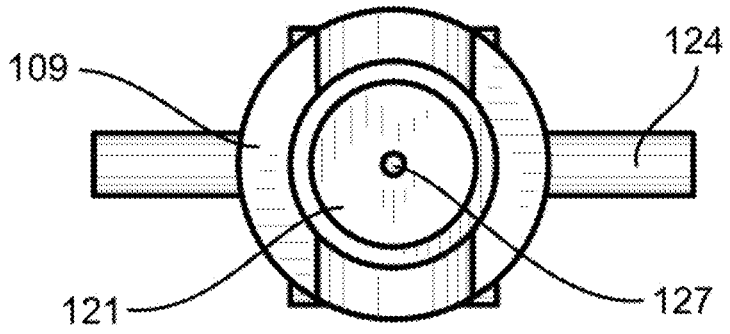
FIG. 6 depicts a bottom view of the faucet cartridge removal tool disclosed herein.
Figure 7:
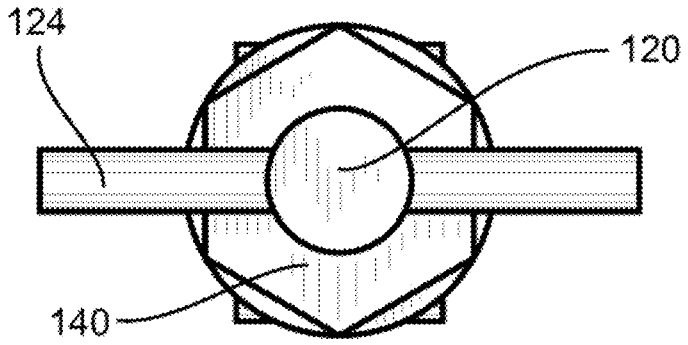
FIG. 7 depicts a top view of the faucet cartridge removal tool disclosed herein.
Figure 8:
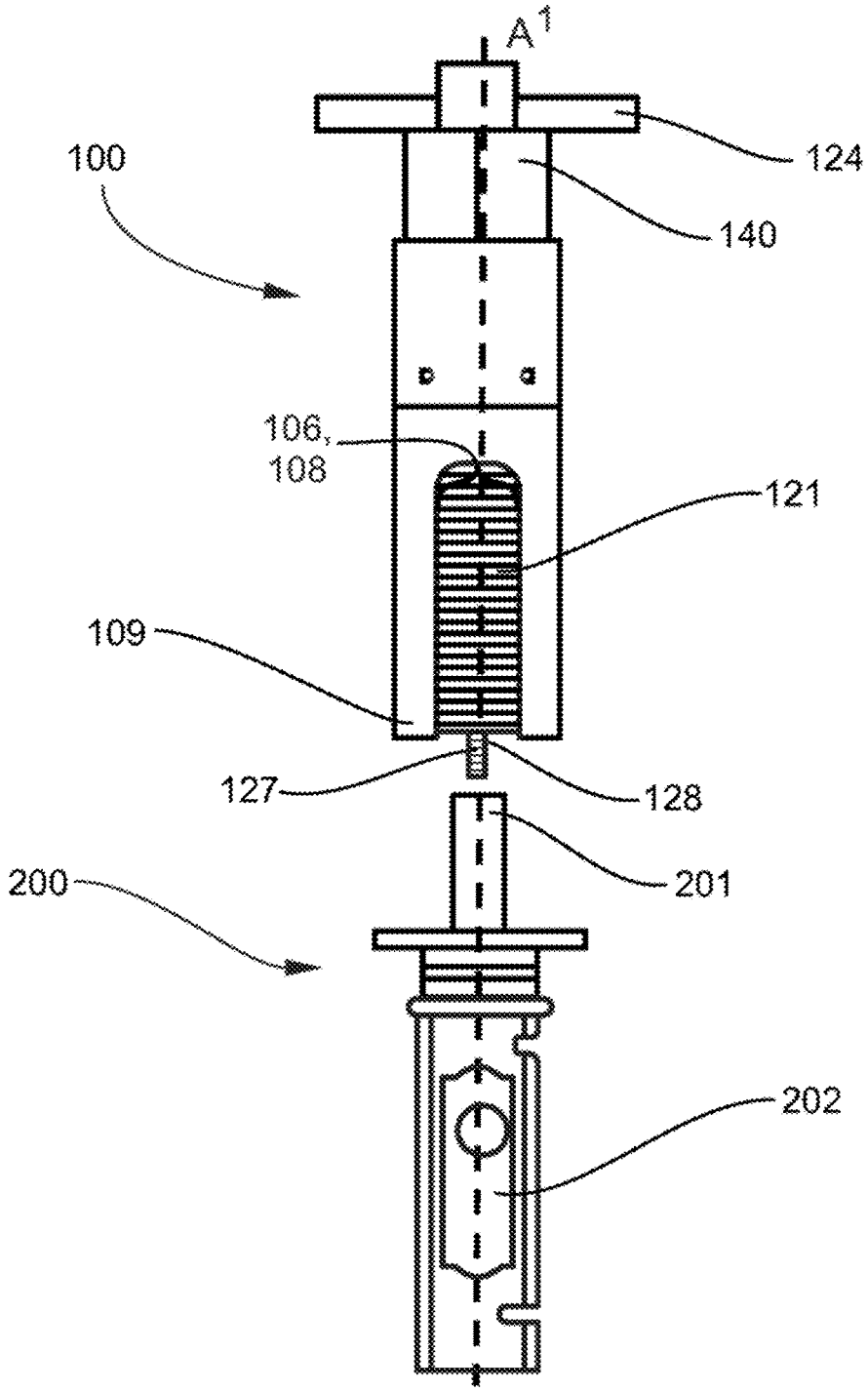
FIG. 8 depicts the faucet cartridge removal tool disclosed being axially aligned with the cartridge before engaging the cartridge stem.

FIGS. 3-7 generally depict the faucet cartridge removal tool 100 as disclosed herein. Specifically, FIGS. 3 and 4 depict two separate perspective views of the removal tool 100, while FIGS. 5A and 5B depict two separate side views thereof. FIG. 6 depicts a bottom view of the tool 100 while FIG. 7 depicts a top view. In view of FIGS. 3-7, specifically disclosed is a faucet cartridge removal tool 100 that limits lateral movement of the tool and faucet cartridge 200 during faucet cartridge removal (further discussed below in view of FIGS. 9A-9G, which sequentially depict the tool engaging and removing a faucet cartridge).

The faucet cartridge removal tool 100 includes a hollow cylindrical main body 104, preferably formed of a rigid, non-deformable material. As discussed further below in view of FIGS. 9A-9G, the hollow cylindrical main body 104, and more specifically the peripheral edges 109 of sidewalls 105, are configured to seat on a faucet valve 300 or faucet cartridge lip to limit lateral movement (shown as direction D3 in FIGS. 9D-9G) of the tool while in use, which advantageously prevents and/or limits accidental breakage of the faucet cartridge 200 including the faucet cartridge stem 201 and/or faucet cartridge main body 202 during removal from a faucet valve 300.

As shown, for example, in FIGS. 3, 4, 5A, and 8, the hollow cylindrical main body 104 includes one or more windows 106, 108 formed thereon for viewing engagement between the tool 100 and faucet cartridge 200 while in use. This is further depicted in FIGS. 9A-9G.

As further shown in FIGS. 3-7, the faucet cartridge removal tool 100 further includes a first movement member 120 partially housed within the hollow cylindrical main body 104 that is also preferably formed of a rigid, non-deformable material and is configured to move about a single linear axis (also referred to as a "single axis" or the "axis")($A^1$) above and below the hollow cylindrical main body 104 relative to a longitudinal axis ($L^1$) of the tool while in use.

As shown in FIGS. 3-90, the first movement member 120 includes a rod 121, a handle 124, and a faucet cartridge engagement member 127. In certain aspects, the rod 121 is partially housed within the main body 104 and viewable through the one or more windows 106, 108 of the hollow cylindrical main body 104. The handle 124 is positioned on one end of the rod 121 and is configured to selectively move/advance the solid rod within the main body 104 in a first direction ($D^1$) about the single linear axis ($A^1$) to in certain instances lower the rod relative the peripheral edges 109 of sidewalls 105 so that the rod 121 and faucet engagement member 127 may be advanced towards a faucet cartridge 200 while the tool 100 is in use. For example, the rod 121 may include threaded outer portions (not shown) that are mated with threaded inner portions in the cylindrical main body 104. The rod 121 (and first movement member 120) may be advanced within the main body 104 by turning the handle 124 in a clockwise manner/direction thereby rotating the rod 121 about the single linear axis ($A^1$), which in turn lowers the rod 121 relative the peripheral edges 109 of sidewalls 105 and advances the rod 121 towards the faucet cartridge 200 while in use. The first movement member 120 further includes a faucet cartridge engagement member 127 positioned on a second end of the rod 121 that is opposite the handle 124. The engagement member 127 is configured to fixedly engage the faucet cartridge during faucet cartridge removal.

In certain aspects, the engagement member 127 includes a threaded portion 128 configured for threaded engagement of the faucet cartridge stem 201 within a threaded inner diameter of stem 201. In certain aspects and as shown, for example, in FIGS. 3, 5A, 5B, and 8, the engagement member 127 extends below the rod 121 of the first movement member and has a smaller outer diameter ($OD^2$) than an outer diameter ($OD^1$) of the rod (solid rod). As shown, for example in FIG. 8, the outer diameter of the engagement member 127 is at least partially threaded 128 along its length, and as further shown in FIG. 8, tool 100, and more specifically the engagement member 127, may be axially aligned (along single axis $A^1$) with stem 201 of faucet cartridge so that engagement member 127 may be fixedly engaged to cartridge stem 201 by advancing threaded portions of the engagement member's outer diameter within a threaded inner diameter of a stem 201 of a faucet cartridge.

As further shown in FIGS. 3-7, the tool 100 further includes a second movement member 140 that is configured to move the rod 121 in a second direction ($D^2$) about the single linear axis ($A^1$) that is opposite the first direction ($D^1$) in order to remove the faucet cartridge 200 during faucet cartridge removal while concurrently maintaining engagement between the faucet cartridge engagement member 127 and faucet cartridge 200 and while concurrently limiting lateral movement of the tool 100. As further shown in FIGS. 3-7, the second movement member 140 is positioned between the handle 124 and hollow cylindrical main body 104. A portion of the rod 121 of the first movement member 120 is enclosed within the second movement 140 and engaged with the second movement member and is biased in direction $D^2$ when the second member is rotated in a counterclockwise manner.

In certain aspects, one or more of the above mentioned components of the tool 100 are formed of rigid, non-deformable material(s), and in certain aspects, all components of tool 100 are formed of rigid, non-deformable material(s).

Figure 9A:
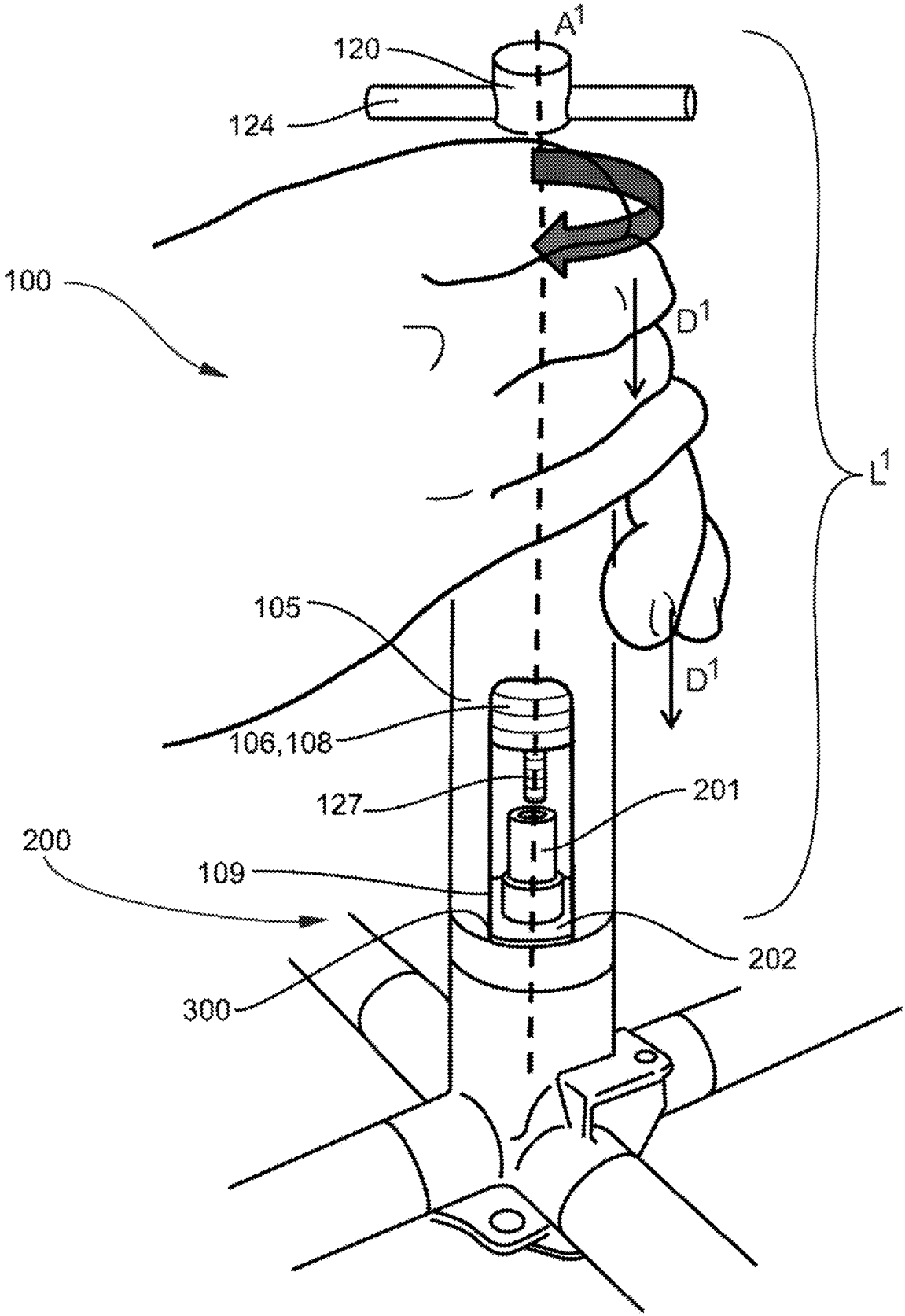
FIGS. 9A-9G depict sequential views of the tool being axially aligned with the cartridge before engaging the cartridge, fixedly engaging stem of the cartridge, and subsequently removing cartridge from valve while using the tool disclosed herein.

In view of the above, FIGS. 9A-9G sequentially depict removal tool 100 being used to engage and remove faucet cartridge 200 from valve 300. Specifically, FIG. 9A depicts the faucet cartridge removal tool 100 being placed over the cartridge 200 such that the peripheral edges of the sidewall 109 contact and seat on valve 300 thereby providing stability to the tool. As further shown in FIG. 9A and further during this step, the user views rod 121 and engagement member 127 through windows 106, 108 and axially aligns the engagement member 127 with the faucet cartridge stem 201 along single axis $A^1$. During axial alignment of engagement member 127 with stem 201, peripheral edges of the sidewall 109 remain in contact with and seat the tool 100 on valve 30) thereby maintaining overall tool stability while in use.

Figure 9B:
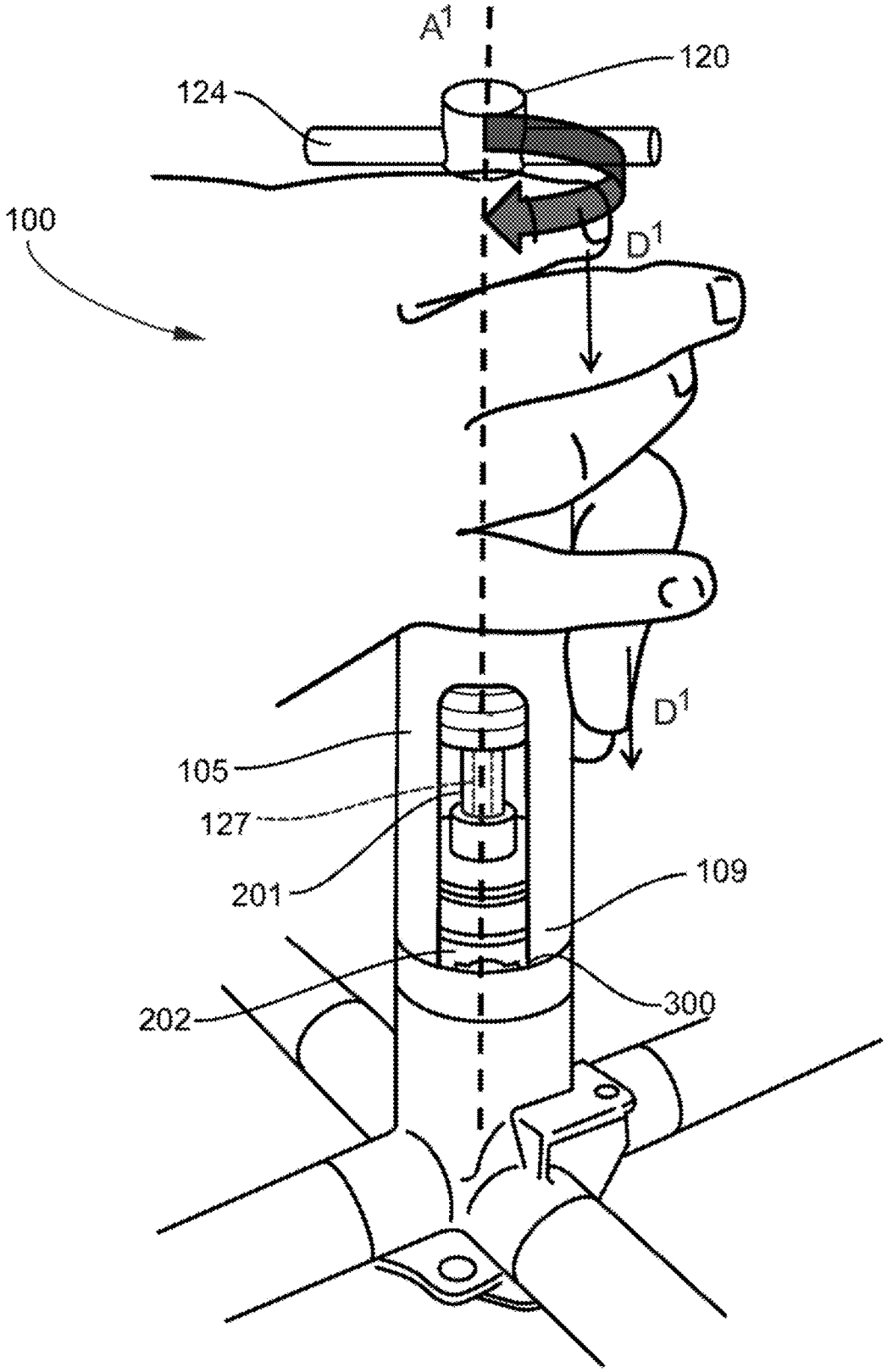
Figure 9C:
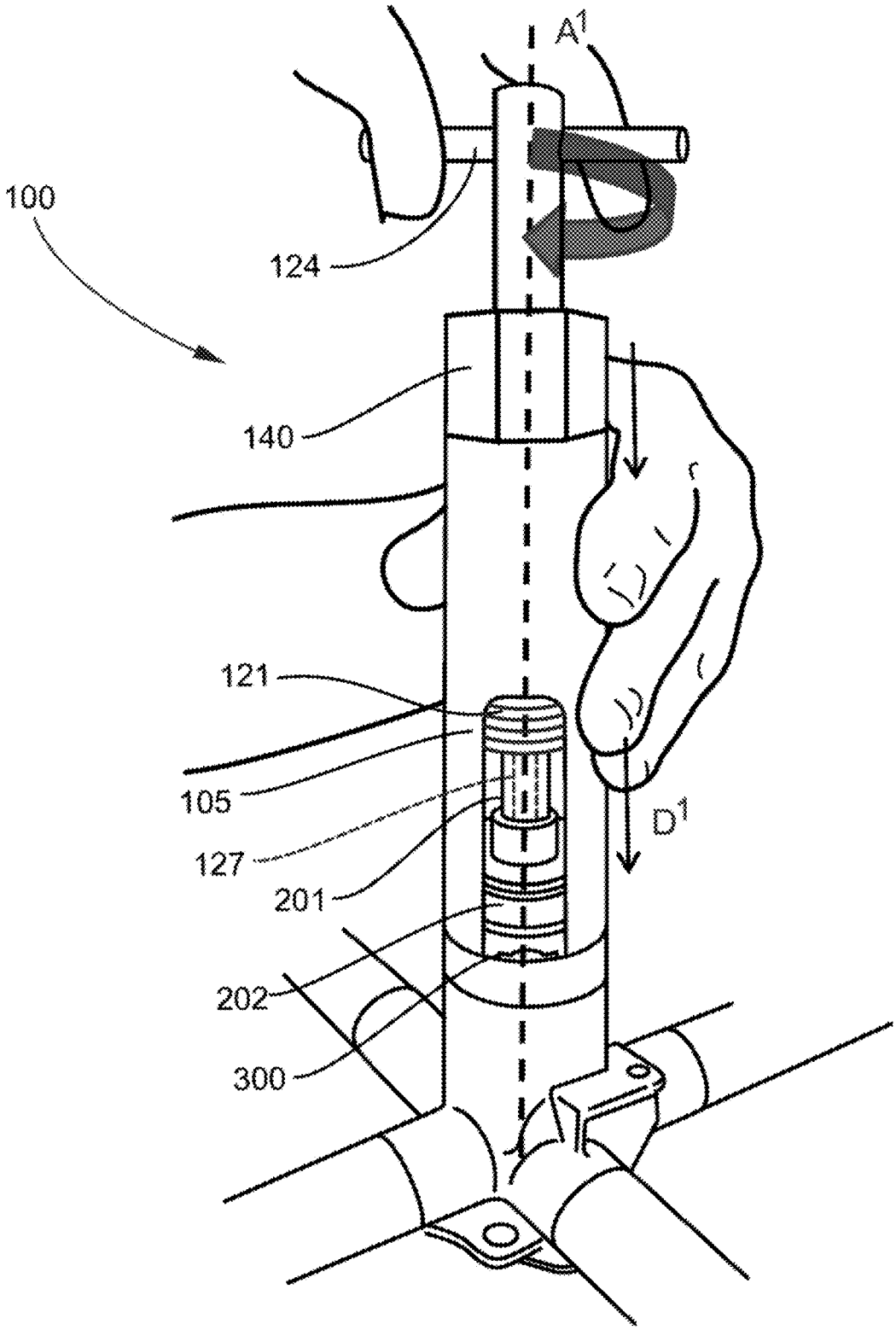

Next, and as sequentially shown in FIGS. 9B and 9C, handle 124 is rotated in a clockwise manner about a single axis $A^1$ to advance the rod 121 and engagement member 127 of the first movement member 120 in direction $D^1$ towards stem 121. As further shown in FIGS. 9B and 9C, handle 124 is rotated until engagement member 127 advances into and securely engages an opening in stem 201 (e.g., threaded outer diameter of the engagement member 127 advances into a threaded inner diameter of stem 201). When in a completely secured, engaged position, engagement member 127 completely or almost completely resides within stem 201, and the bottom of rod 121 is above and directly adjacent to outermost portions of stem 201.

Next and after securely engaging engagement member 127 within stem 201 (as shown in FIG. 9C), the second movement member (concealed by user's hand in FIG. 9D) is rotated in a counterclockwise manner (as indicated by arrow adjacent single axis $A^1$ in FIG. 9D) to begin moving rod 121, engagement member 127, and faucet cartridge (i.e., faucet cartridge stem 201 and faucet cartridge main body 202) in a direction (D) away from valve along the single axis $A^1$ thereby beginning to remove the faucet cartridge 200 from valve 300. In certain aspects, second movement member 140 does not impart rotational movement on engagement member 127 that would disengage engagement member from stem 201. Therefore, engagement member 127 remains securely engaged to stem 201 while second movement member 140 is rotated. As further shown in FIG. 9D, peripheral edges of sidewalls 109 remain in contact with valve 300 during this step thereby maintaining overall tool stability during this step and further reducing or eliminating movement outside of the single axis $A^1$ (e.g., lateral or side to side movement generally termed "$D^3$").

Figure 9D:
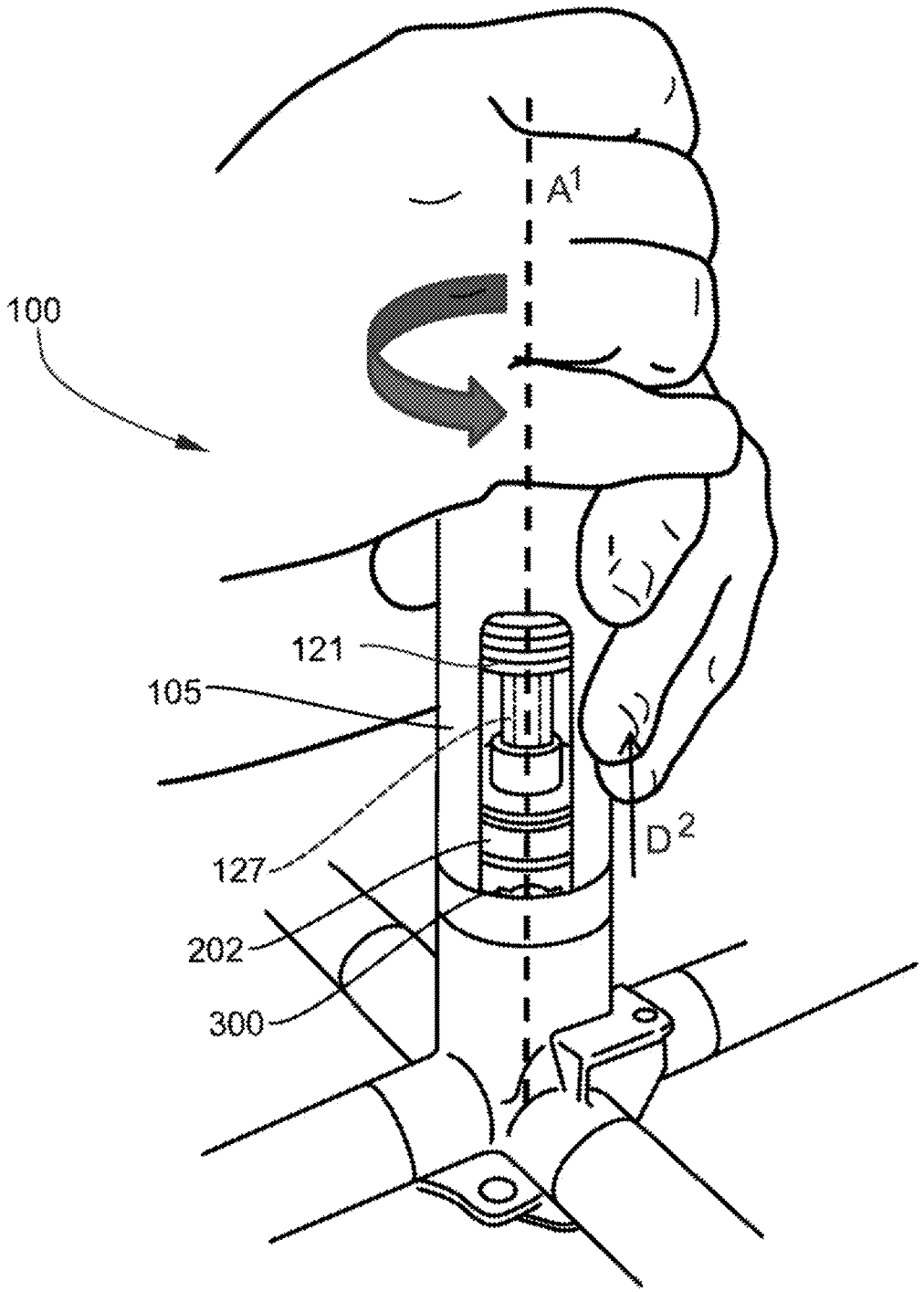
Figure 9E:
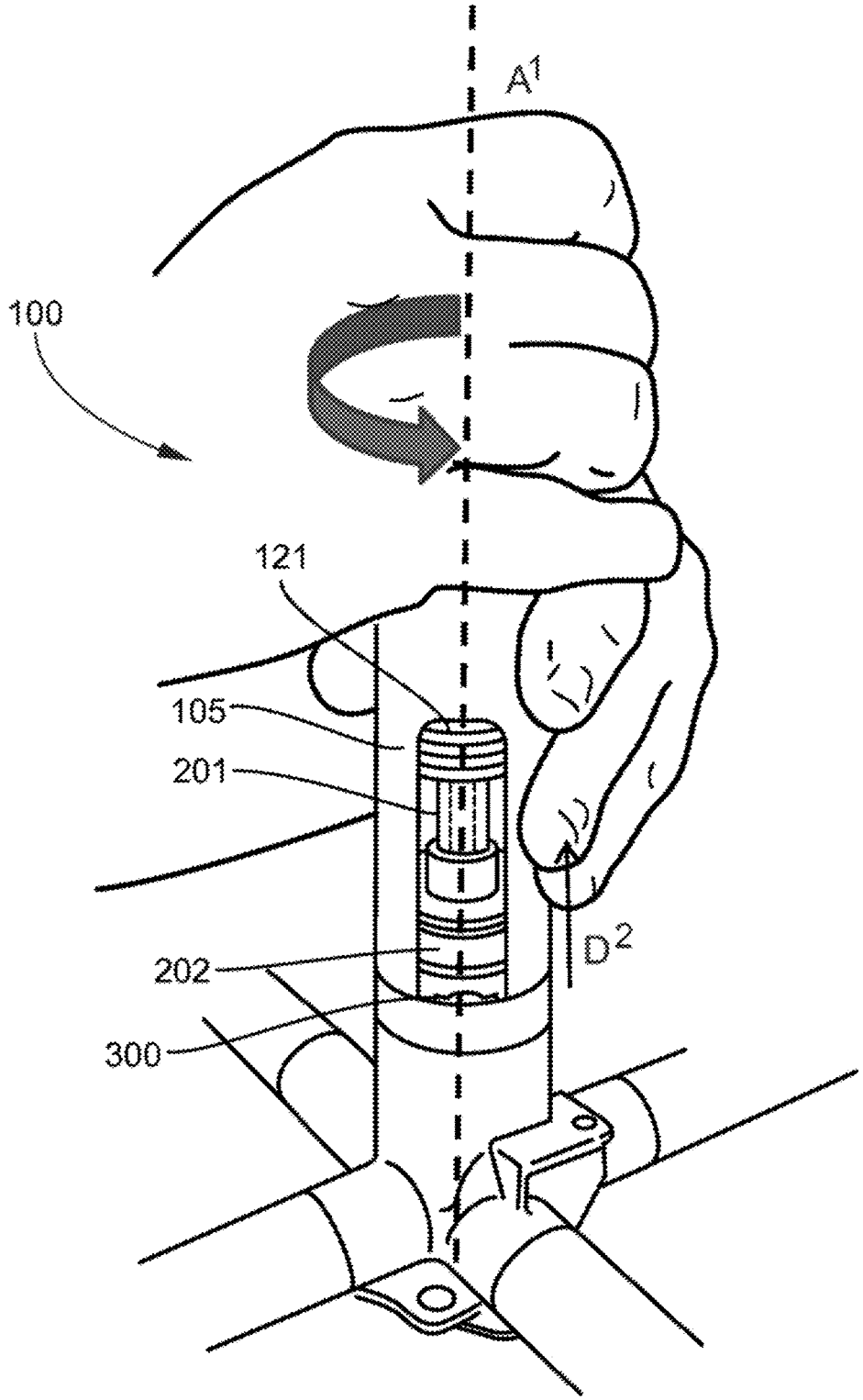
Figure 9F:
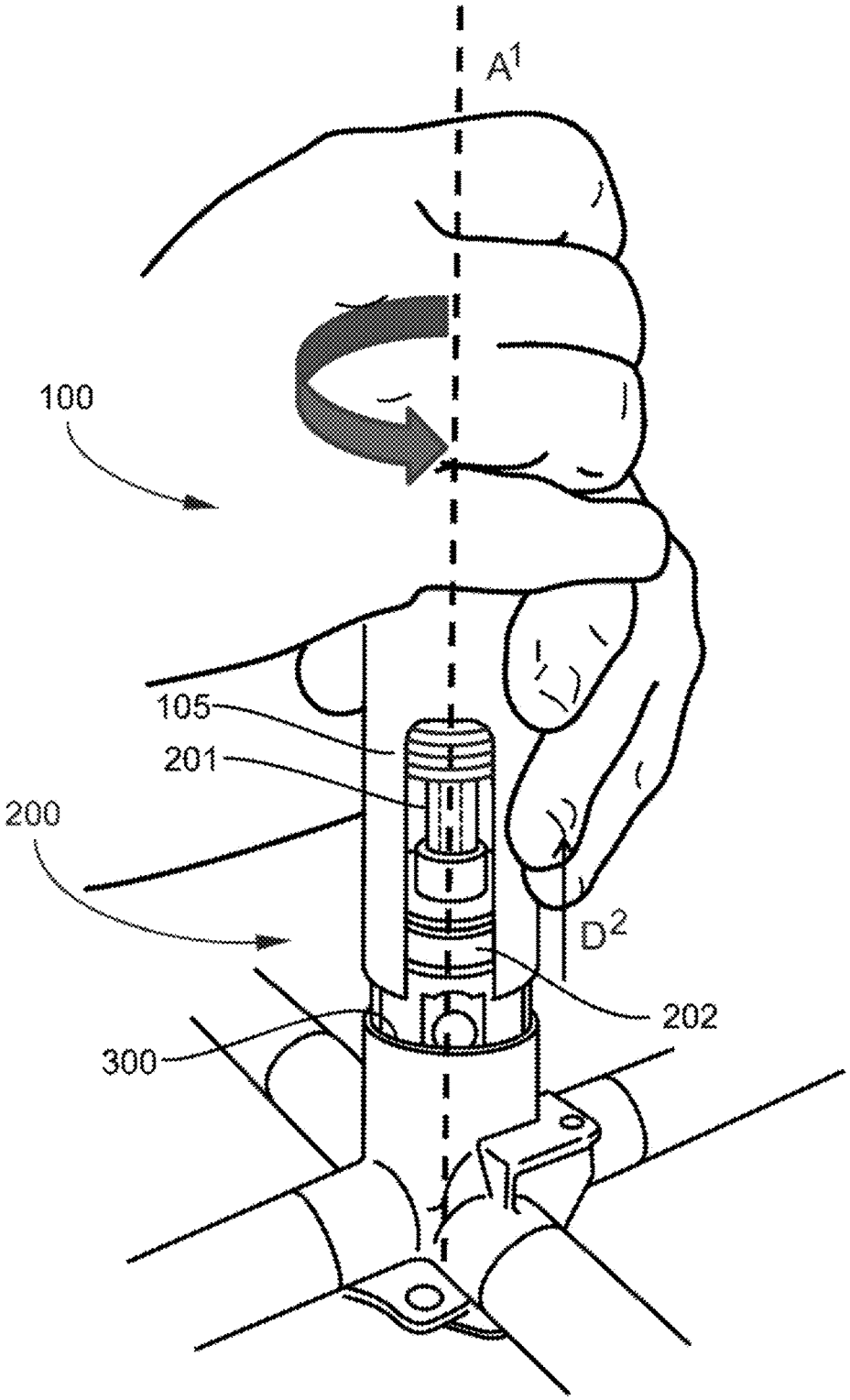

FIGS. 9E and 9F are a continuation of FIG. 9D. Specifically, FIGS. 9E and 9F depict a user continuing to rotate second movement member 140 in a counterclockwise manner along single axis $A^1$ such that the rod 121, engagement member 127, and faucet cartridge 200 (i.e., faucet cartridge stem 201 and faucet cartridge main body 202) continuously to move in a direction ($D^2$) away from valve 300 thereby selectively removing faucet cartridge 200 from valve 300 and slowly revealing more of faucet cartridge main body 202 to the tool user via windows 106, 108 as second movement member 140 is rotated. During this step and as further shown in FIGS. 9E and 9F, sufficient clearance is provided inside tool's sidewalls 105 allowing faucet cartridge 200 (faucet cartridge stem 201 and faucet cartridge main body 202) to be received within the hollow cylindrical main body 104 while the user removes cartridge 200 from valve and concurrently continually views rod 121, stem 201, and main body 202 through windows 106, 108.

Figure 9G:
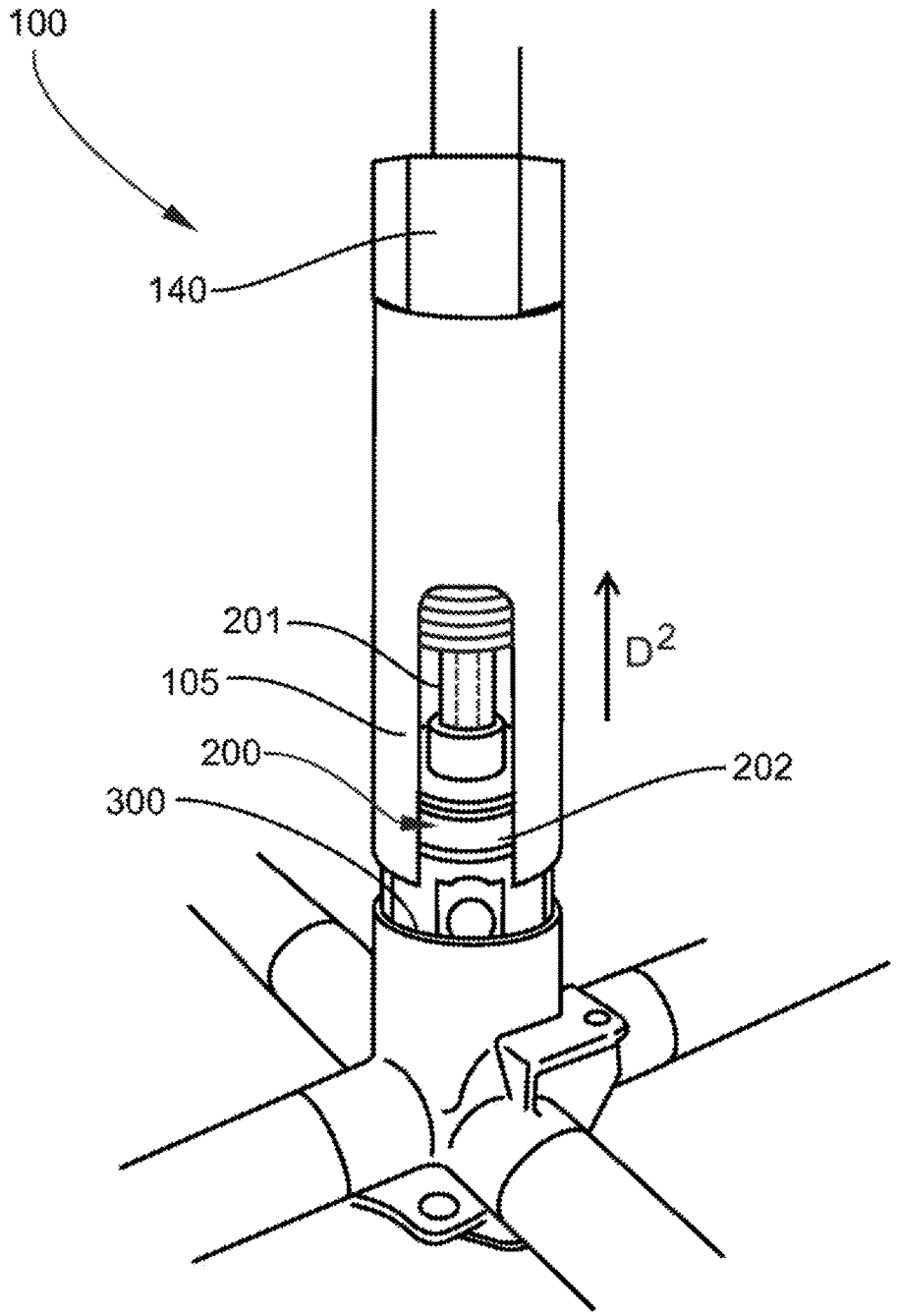

FIG. 9G depicts the majority of cartridge main body 202 being removed from the valve while peripheral edges of the sidewall 109 remain in contact with and seat the tool 100 on valve 300 thereby maintaining overall tool stability while in use by limiting lateral or side to side movement generally termed "D". After this step, cartridge 200 may be remove from valve 300 be simply lifting tool 100 away from valve 300 thereby unseating peripheral edges 109 of sidewall and removing the overall tool 100 with cartridge affixed thereon from the valve.

The foregoing description provides embodiments of the invention by way of example only. It is envisioned that other embodiments may perform similar functions and/or achieve similar results. Any and all such equivalent embodiments and examples are within the scope of the present invention and are intended to be covered by the appended claims.

What is claimed is:

1. A faucet cartridge removal tool that limits lateral movement of the tool and faucet cartridge during faucet cartridge removal, the tool comprising:

(a) a hollow cylindrical main body configured to seat on a faucet valve or faucet cartridge lip to limit lateral movement of the tool while in use, the hollow cylindrical main body having one or more openings formed thereon for viewing engagement between the tool and the faucet cartridge while in use;

(b) a first movement member partially housed within the hollow cylindrical main body and configured to move about a single axis above and below the hollow cylindrical main body relative to a longitudinal axis of the tool while in use, the first movement member comprises:

(i) a rod partially housed within the main body and viewable through the one or more openings, (ii) a handle positioned on one end of the rod that is configured to selectively rotate about the single axis in a first rotational direction to move the rod within the main body in a first direction along the single axis, and (iii) a threaded faucet cartridge engagement member positioned on a second end of the rod that is configured to fixedly engage the faucet cartridge during faucet cartridge removal; and (c) a second movement member that is configured to selectively rotate about the single axis in a second rotational direction, the second rotational direction opposite the first rotational direction, to move the rod in a second direction along the single axis that is opposite the first direction to remove the faucet cartridge during faucet cartridge removal while concurrently maintaining engagement between the threaded faucet cartridge engagement member and the faucet cartridge and limiting lateral movement of the tool, wherein the threaded faucet cartridge engagement member allows reverse gripping when the handle is rotated in the first rotational direction and removal of the faucet cartridge when the second movement member is rotated in the second rotational direction.

2. The faucet cartridge removal tool of claim 1, wherein the rod rotationally moves in a clockwise manner about the single axis when advancing the rod through the main body in the first direction.

3. The faucet cartridge removal tool of claim 1, wherein the threaded faucet cartridge engagement member is configured for engagement within a threaded inner diameter of a stem of the faucet cartridge.

4. The faucet cartridge removal tool of claim 3, wherein the threaded faucet cartridge engagement member extends below the rod of the first movement member and has a smaller outer diameter than an outer diameter of the rod, the outer diameter of the threaded faucet cartridge engagement member is at least partially threaded along its length and configured for engagement within the threaded inner diameter of the stem of the faucet cartridge.

5. The faucet cartridge removal tool of claim 4, wherein the second movement member is positioned between the handle and the hollow cylindrical main body.

6. The faucet cartridge removal tool of claim 5, wherein a portion of the rod of the first movement member is enclosed within the second movement member and engaged with the second movement member.

7. The faucet cartridge removal tool of claim 6, wherein the threaded faucet cartridge engagement member is attached to a bottom of the rod and extends below the rod of the first movement member in a direction away from the tool and has the smaller outer diameter than an the outer diameter of the rod, the outer diameter of the threaded faucet cartridge engagement member is completely threaded along its length and configured for engagement within the threaded inner diameter of the stem of the faucet cartridge such that the bottom of the rod is flush with and adjacent to an outermost surface of the faucet cartridge when the threaded faucet cartridge engagement member is completely engaged with the faucet cartridge.

8. A kit comprising the faucet cartridge removal tool of claim 1.

9. A method of removing a faucet cartridge comprising:

(a) providing the faucet cartridge removal tool of claim 1;

(b) placing or seating the hollow cylindrical main body of the threaded faucet cartridge removal tool on a faucet valve or faucet cartridge lip having the faucet cartridge positioned therein such that lateral movement of the tool relative to the faucet cartridge, faucet valve, and/or faucet cartridge lip is reduced and/or eliminated while the tool is in use;

(c) after step (b), while the hollow cylindrical main body remains placed or seated on the faucet valve or faucet cartridge lip, rotating the handle of the tool in the first rotational direction such that the rod and the threaded faucet cartridge engagement member of the first movement member concertedly move along the single axis in the first direction towards the faucet cartridge until the threaded faucet cartridge engagement member fixedly engages the cartridge member to allow for reverse gripping;

(d) after step (c) and while the hollow cylindrical main body remains placed or seated on the faucet valve or faucet cartridge lip, rotating the second movement member of the tool in the second rotational direction that is opposite the first rotational direction such that the rod moves the second direction along the single axis that is opposite the first direction away from the faucet valve to completely remove the faucet cartridge from the faucet valve while concurrently maintaining engagement between the threaded faucet cartridge engagement member and the faucet cartridge and limiting lateral movement of the tool.

10. The method of claim 9, wherein the threaded faucet cartridge engagement member is configured for engagement within a threaded inner diameter of a stem of the faucet cartridge.

11. The method of claim 10 wherein the threaded faucet cartridge engagement member extends below the rod of the first movement member and has a smaller outer diameter than an outer diameter of the rod, the outer diameter of the threaded faucet cartridge engagement member is at least partially threaded along its length and configured for engagement within the threaded inner diameter of the stem of the faucet cartridge.

12. The method of claim 11, wherein the second movement member is positioned between the handle and the hollow cylindrical main body.

13. The method of claim 12, wherein a portion of the rod of the first movement member is enclosed within the second movement member and engaged with the second movement member.

* * * * *